United States Patent [19]

Thomas

[11] 4,091,884

[45] May 30, 1978

[54] ROTARY AIR PERCUSSION BIT

[75] Inventor: Robert D. Thomas, Tonkawa, Okla.

[73] Assignee: Smith International, Inc., New Port Beach, Calif.

[21] Appl. No.: 741,560

[22] Filed: Nov. 15, 1976

[51] Int. Cl.[2] ..... E21C 13/00

[52] U.S. Cl. ..... 175/410; 175/395

[58] Field of Search ..... 175/394, 395, 410, 414, 175/415, 417, 418

[56] References Cited

U.S. PATENT DOCUMENTS

| | | | |
|---|---|---|---|
| 3,071,201 | 1/1963 | Phipps | 175/410 |
| 3,158,216 | 11/1964 | Baron et al. | 175/410 X |
| 3,346,060 | 10/1967 | Beyer | 175/410 |
| 3,608,654 | 9/1971 | Powell | 175/395 X |
| 3,885,638 | 5/1975 | Skidmore | 175/410 X |
| 3,915,246 | 10/1975 | Shestawy | 175/410 X |
| 3,955,635 | 5/1976 | Skidmore | 175/410 X |

*Primary Examiner*—Ernest R. Purser
*Assistant Examiner*—Richard E. Favreau

[57] ABSTRACT

A rotary air percussion bit has a cylindrically shaped sidewall, a body portion with a flat or recessed face on one end and a shank attached to the remaining end. A plurality of inserts of wear resistant material is mounted in the face and extending outwardly therefrom. A plurality of chip cutting grooves is formed in the face and extending radially from the axis of the body outwardly to the sidewalls. In order to improve the chip removal from the bit a plurality of chip clearance grooves is formed in the sidewall of the body extending from the terminus of the face chip cutting grooves and spiraling from the face to the shank end. The angle of the spiral with respect to the face is less than 45°.

3 Claims, 2 Drawing Figures

ROTARY AIR PERCUSSION BIT

BRIEF DESCRIPTION OF THE PRIOR ART

Rotary air percussion bits are generally constructed along the lines of those disclosed in U.S. Pat. No. 3,346,060. In that patent slots in the face of the drill extend radially outward toward the sidewalls. There may be one or more slots extending from the center of the face to the sidewalls. Generally these air percussion drills will also incorporate vertical chip clearance slots which begin at the terminus of the chip clearance slot in the face and extend vertically from the face toward the shank of the drill. Additional circumferential slots may be incorporated around the drill for mounting of inserts and for providing the chip clearance relief.

BRIEF DESCRIPTION OF THE INVENTION

This invention relates to an improvement in chip removal for a rotary air percussion drill bit. One of the biggest contributing factors to the reduction in life of a rotary air percussion drill bit is the accumulation of chip particles in and around the metal parts of the drill, therefore, as the drill is working in a bore hole, the chips tend to accumulate and pack causing excessive wear on the metal support parts of the drill bit which hold the hard carbide inserts. As the metal is worn away the support structure for the inserts is worn away causing the inserts to break or fall out. The failure of the gauge inserts to retain proper position in the drill will cause premature removal of the drill bit and as a consequence increased expense in drilling the bore hole. By necessity each removal of the drill bit will require a period of time to not only remove the bit and the structure holding the bit in the hole but the reinsertion of a new bit.

This invention provides an improvement in a rotary percussion bit which has a cylindrically shaped sidewall body portion with a flat or recessed face on one end and a shank attached axially to the remaining end. A plurality of inserts of wear resistant material is mounted in the face and extending outwardly therefrom. A plurality of inserts is likewise mounted in the cylindrically shaped sidewall for gauge maintenance of the drill bit. A plurality of chip cutting grooves is formed in the face and extends from the center of the face radially outward to the cylindrically shaped sidewall. This invention provides a unique method for removing the chips once they have reached the sidewall by providing ramps formed into the cylindrical sidewall of the drill bit extending from the face to the shank portion of the drill bit. These ramps provide a unique means for the chips to walk up the sidewalls of the ramp bypassing the cylindrical sidewalls where compaction of the drill chips would cause damage to the inserts mounted in the cylindrical sidewalls. The walking up of the chips is created by the continual vibration and rotation of the drill bit as it is rotated in the base of the bore hole being formed.

It has been found that an angle of approximately 40 degrees provides the best angle for the chips to walk up the incline from the face to the shank portion. It is obvious that other angles can be used as will be later discussed.

DETAILED DESCRIPTION OF THE INVENTION

Figure 1:
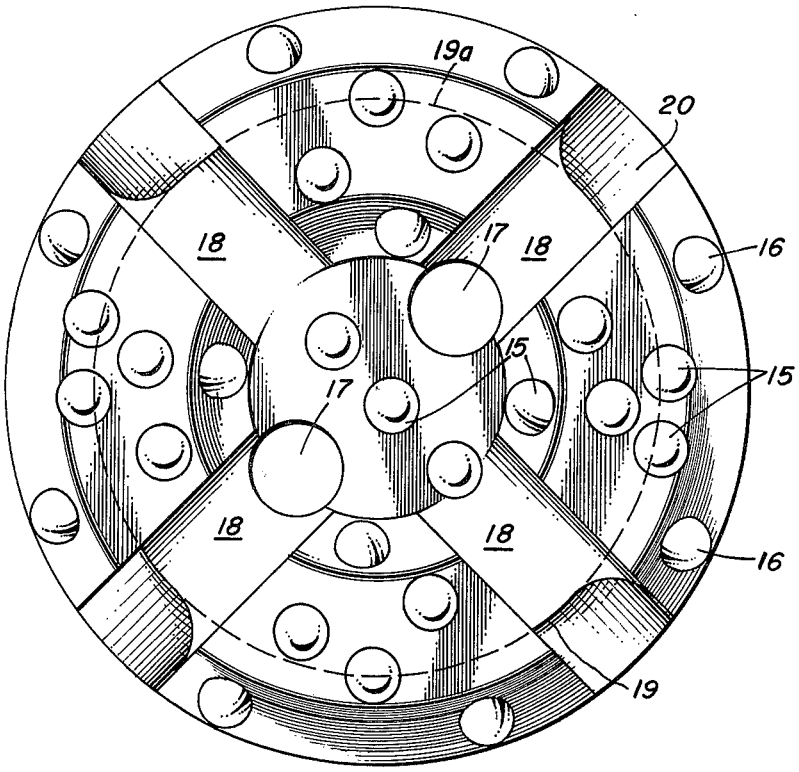
FIG. 1 illustrates a view of the face of the improved drill bits showing the location of the ramps with respect to the face chip clearance slots.
Figure 2:
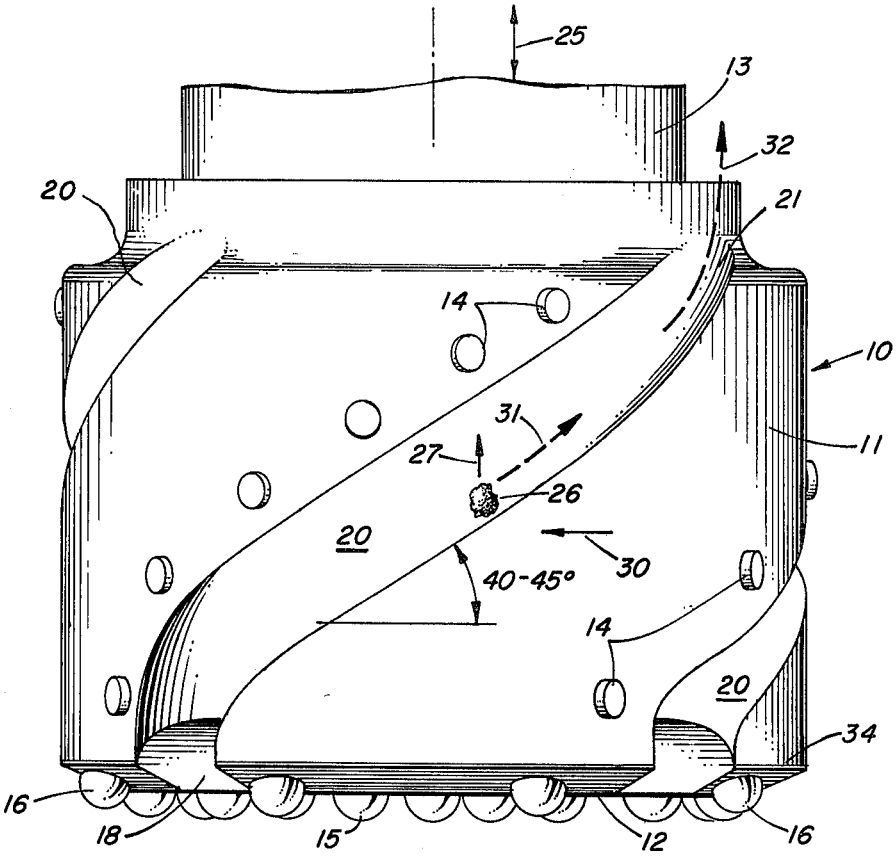
FIG. 2 shows the placement of the ramps in the cylindrical sidewall of the bit.

Similar numbers will be used throughout the specification for similar elements.

Referring to both of the FIGURES, an air percussion drill bit generally referred to by the arrow 10 has a cylindrical side 11, an end face 12 and a shank 13 axially mounted to the opposite end of cylindrical body 11. A plurality of gauge inserts 14 is mounted in the cylindrical side body 11 of the drill bit 10 and provides a means of maintaining a particular size gauge for the hole being drilled. Face 12 is provided with a plurality of cutting carbides or inserts 15 and reaming inserts or cutters 16. The operation and function of these carbides are well known and will not be discussed further in this application.

Referring in particular to FIG. 1, a pair of openings or holes 17 provides a passage for air or fluid under pressure which passes down shank 13 through holes provided (not shown) to holes 17. In order to provide a means for removal of chips a plurality of slots 18 is provided in the face 12 of drill bit 10. These slots 18 extend from the axis of drill bit 10 outwardly to the cylindrical body 11.

One of the novel features of this invention is the provision of a ramp for the removal of chips. The ramp 20 extends from chip clearance slot 18 spirally along cylindrical body 11 to upper portion 21 of drill bit 10 the slot 20 has a depth 19 which on end view FIG. 1 is also illustrated by dotted lines 19*a*. The angle that ramp 20 makes with face 12 is approximately 40 to 45 degrees. This angle, of course, can be varied so long as the particles such as 26 walk up ramp 20 under the verticle and rotational forces imparted to drill bit 10.

OPERATION

The operation of the improved drill bit is as follows: Drill bit 10 is connected to the usual air percussion drill apparatus which generally comprises a drive motor connected to a drill string which has on its terminus drill bit 10. Air is passed down the drill string either on the outside of the drill pipe and up the center of the drill string or down the center of the drill string and up the bore hole. Drill bit 10 will, through vertical movement along arrow 25, impact the bottom of the bore hole with inserts 15 and 16 breaking away the rock and forming a bore hole. Both vertical motion along arrow 25 and rotation motion along arrow 30 are applied. Rotational motion causes the drill bit to slowly turn breaking the hole in a round circular pattern and freeing chips. As the chips are freed, chips such as 26 will pass along slots 18 to the outer circumference of cylindrical body 11 and up ramp 20. Since a vertical force is being applied continually to the drill bit along arrow 25, a similar vertical force 27 is being applied to particle 26. In addition to vertical force 27, rotational force 30 is being applied. This continual rotational and vibrational force will cause chip 26 to move along the dotted arrow 31 up the ramp 20 and in the direction of arrow 32 to the shaft portion 13 of drill bit 10. Once the particle has reached shaft portion 13, it no longer can cause wear on the outer cylindrical body 11. It is the continual wear of cylindrical body 11 that loosens the gauge teeth 14 by causing the metal around teeth 14 to erode away, thereby either causing breakage or loss of the gauge teeth. When these teeth are lost a drill can no longer maintain a proper gauge and the drill must be removed and replaced and the hole reamed to proper diameter. Wear can also cause erosion of the edges 34 causing the loss of reaming cutters 16, thus an easy, free path for the chips along the ramp 20 will provide an extremely longer wearing drill bit. Such a drill bit has been constructed along the lines of the invention disclosed herein and it was found that in a test compared to that of an ordinary bit that the improved bit of this invention lasted approximately ⅓ longer while maintaining the gauge of the hole. It can be seen that the improved ramping structure for the removal of chips has greatly improved the life and overall efficiency and cost, realizing a substantial cost reduction in the production of a bore hole using the percussion air drill method of forming the bore hole.

A particular preferred angle of 40° to 45° has been shown in the drawings as being that angle which provides the best configuration for the preferred embodiment, however, other angles can be substituted depending upon the diameter of the drill, the rotational speeds provided to the drill and the vertical velocities being imparted along shaft 13. The invention basically resides in providing a spiral ramp in the cylindrical body of the drill which has a ramp angle sufficient to move the particles up the ramp when the designed verticle forces and rotational forces are applied to the air percussion bit.

What I claim is:

1. In a rotary percussion bit having a cylindrically shaped sidewall body portion with a face on one end and a shank attached axially to the remaining end, a plurality of inserts of wear resistant material mounted in said face and extending outwardly therefrom and a plurality of grooves formed in said face and extending from the axis of said body outwardly to said sidewalls, an improvement comprising a plurality of groove means formed into the sidewall of said body extending from the terminus of said face grooves and spiraling from said face end to said shank end, the angle of said spiraling groove means with respect to said face being less than 45°, said spiraling groove means causing dislodged chips to be conveyed up said spiraling groove by vibratory and rotational movement of said bit.

2. An improved bit as defined in claim 1 wherein said spiraling groove means forms an angle with said face of 40°.

3. An improved bit as defined in claim 1 wherein a plurality of inserts is mounted at spaced intervals to extend outwardly in the cylindrical surface of said bit between the upper edge of said spiraling groove means and the shank end of said bit.

* * * * *